United States Patent [19]

Weninger, deceased et al.

[11] Patent Number: 4,663,993

[45] Date of Patent: May 12, 1987

[54] HAND OPERATED DEVICE FOR THE TREATMENT OF SKI EDGES

[76] Inventors: Johann P. Weninger, deceased, late of Telfs; by Roland Weninger, heir, Saglstrasse 70, A-6410, Telfs, both of Austria

[21] Appl. No.: 772,956

[22] PCT Filed: Dec. 30, 1983

[86] PCT No.: PCT/AT83/00038

§ 371 Date: Aug. 27, 1985

§ 102(e) Date: Aug. 27, 1985

[87] PCT Pub. No.: WO85/03008

PCT Pub. Date: Jul. 18, 1985

[51] Int. Cl.[4] ..... A63C 11/06; B23D 67/12

[52] U.S. Cl. ..... 76/83; 29/80

[58] Field of Search ..... 76/83, 88, 82; 51/205 WG, 211, 214, 285; 29/78, 80

[56] References Cited

U.S. PATENT DOCUMENTS

| | | | |
|---|---|---|---|
| 1,006,940 | 10/1911 | Haynes | 76/83 |
| 3,561,169 | 2/1971 | Pirzek . | |
| 3,670,601 | 6/1972 | Weeks | 76/83 |
| 3,693,219 | 9/1972 | Falkenberg . | |
| 4,121,484 | 10/1978 | Gorlach | 76/83 |
| 4,189,874 | 2/1980 | Labriola | 76/83 |

FOREIGN PATENT DOCUMENTS

| | | |
|---|---|---|
| 319828 | 11/1971 | Austria . |
| 333170 | 11/1974 | Austria . |
| 341396 | 3/1976 | Austria . |
| 938954 | 2/1956 | Fed. Rep. of Germany . |
| 2162046 | 7/1973 | France . |
| 499336 | 1/1971 | Switzerland . |

*Primary Examiner*—Roscoe V. Parker

*Attorney, Agent, or Firm*—Pahl, Lorusso & Loud

[57] ABSTRACT

A hand device is provided with two individual pairs of surfaces, each of which includes a guide surface and a dressing surface of a tool. In that arrangement the second guide surface is wider by a multiple than the first guide surface and the second dressing surface. As the width of the first dressing surface is preferably variable, a surface strip portion out of which a contact member can preferably be displaced extends at a uniform distance relative to the first guide surface, so that the overall width approximately corresponds to that of the second guide surface.

The holder is of L-shaped cross-section and the tool which is provided with cutting edges on both sides projects beyond the second limb portion of the holder and forms both dressing surfaces. The tool is fixed by a clamping effect which is provided exclusively centrally, so that it can flex in its lengthwise direction on both sides.

11 Claims, 6 Drawing Figures

HAND OPERATED DEVICE FOR THE TREATMENT OF SKI EDGES

Figure 1:
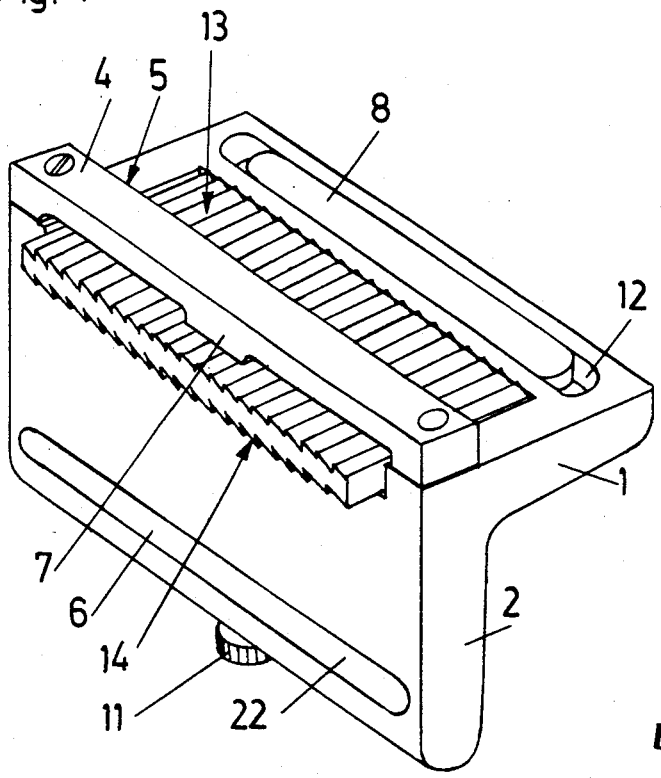

The invention relates to a hand device for dressing ski edges, comprising a holder on which there is provided a pair of surfaces at right angles to each other, for bearing against the running surface and a side surface of the ski, of which one surface is formed at least in part as a cutting dressing surface of a tool and the other is formed as a guide surface of the holder, wherein the width of the surface having the dressing surface is greater than the width of the guide surface.

A device of that kind is disclosed for example in AT-B-No. 319828. Fitted into a base plate provided with a handle is a flat file or a flat milling plate which is fixed by a loop member which extends thereover in the longitudinal direction. The loop member or bar divides the dressing surface into two strips, the width of which can be altered by transverse displacement of the loop member as the fixing screws thereof are guided in transversely extending slots in the base plate. In that arrangement, displacement of the loop member results in particular in better use being made of the dressing surface. The flat file is only in contact in the recess in the base plate at its center so that, when dressing ski edges which in particular extend in a concave configuration in the region of the binding, the two ends of the tool which are arranged with some clearance relative to the base plate can adapt to those edges. For the purposes of dressing the ski edge surface at the running surface side, the hand device is caused to bear against the side surface of the ski, with the side surface serving as a guide surface, with good contact against the running surface being provided by the base plate. However, contact of that kind does not occur when the ski edge surface at the side surface portion is to be dressed as in that case the narrow guide surface of the loop member must be applied against the running surface, and the surface of the base plate, such surface being wider in itself, or the dressing surface, bears against the narrow side surface of the ski, with dressing being difficult in the region of the binding portion. In an embodiment which is not described in greater detail, the loop member may also be adjustable at an angle to the dressing surface so that it can be adapted to ski edges which are not at a right angle.

AT-B-No. 341 396 discloses an edge sharpening device which comprises a holder that is substantially L-shaped in cross-section and on one limb portion of which the flat file is supported, and which has extending thereover a member which is integrally connected to the limb portion at its longitudinal side. The flat file lies on two transverse ribs adjacent the ends of the holder, and is clamped in position by a screw which is arranged in the member extending over the file so that the file can also flex to adapt to the concave curvature of the edges of the ski. In that arrangement, the outside surface of the second limb portion of the holder forms the guide surface and the flat file projects beyond the guide surface so that this arrangement also provides a pair of working surfaces which are at right angles to each other, wherein the width of the dressing surface is substantially smaller. In that edge dressing device, good contact or support is provided when the guide surface of the second limb portion is caused to bear against the running surface of the ski and the ski edge surface which is at the side surface side is being dressed. The support action is also poor again if the ski edge surface at the running surface side is to be dressed as in that case the guide surface, which in itself is wide, bears against the narrow side surface of the ski and the narrow dressing surface bears against the running surface of the ski, while problems in regard to handling may also occur in the binding region. With that construction, it is possible to dress ski edges which are not of a right-angled configuration as the transverse support ribs for the flat file may be replaced by wedge-shaped ribs.

AT-B-No. 333 170 discloses a ski edge dressing device having a holder which is also L-shaped in cross-section, wherein a flat file is fixed to the inside of the one limb portion. In that arrangement, the guide surface is formed by the inside of the second limb portion. That device also only provides a good support action when the ski edge surface at the side surface side is to be dressed as in that case the guide surface can be applied against the running surface of the ski. In that arrangement, the second limb portion which stands up too far constitutes an impediment in the region of the binding, in any position. Angular adaptation is possible only by exchanging the flat file or by adjusting the angle between the two limb portions.

Finally, DE-C-No. 938 954 discloses a dressing device with a holder which is also L-shaped in cross-section, wherein a roller which has cutter discs is arranged pivotably about an axis that is parallel to the longitudinal direction, in such a way that the cutter discs can be pivoted out in the region of the cutting edge of the insides of the two limb portions. Depending on the extent of the pivotal movement, a tangential plane which can be laid against the cutter disc, at the line of cut, extends at a right angle, an acute angle or an obtuse angle, with the inside of the limb portion carrying the pivot axis, so that a good support action is also provided only when the ski edge surface at the side surface side is to be dressed as in that case the limb portion of the holder which carries the pivot axis is applied against the running surface.

The invention is now based on the problem of so developing a hand device of the kind set forth in the opening part of this specification, for dressing ski edges, that when dressing both outside surfaces of the ski edges, the device not only provides for good contact at the ski edge surface, but in addition obstruction by the binding members is eliminated to the maximum possible degree. In that connection, in a preferred embodiment, the invention also seeks to provide for easy adjustment of the dressing angle which makes it possible to dress ski edges which are referred to as 'hanging' ski edges, that is to say, ski edges which extend from the running surface to the side surfaces of the ski, rising at an angle of up to about 3°, without resetting to 90° being necessary for edge dressing at the side surface of the ski.

According to the invention, that problem is now solved in that provided on the holder is a further pair of surfaces at right angles to each other, comprising a second dressing surface and a second guide surface, wherein the width of the second guide surface is greater than the width of the guide surface of the first pair of surfaces.

The configuration in accordance with the invention, of two pairs of working surfaces, each of which comprises a guide surface and a dressing surface, now permits the second guide surface to be substantially increased in width. Therefore, a contact area of suitable size is provided, at the running surface of the ski, not only when the ski edge surface at the running surface side is being dressed, as in the case of the dressing tool set forth in the opening part of this specification, but a contact area of suitable size is provided by the substantially wider second guide surface whose width preferably corresponds at least to the width of the surface including the first dressing surface, even when the ski edge surface at the side surface side is being dressed. In that arrangement, in any position of use of the device, the surface bearing against the ski side surface is so narrow that the device can also be operated in a condition of bearing against the ski edge, even in the region of the binding and in particular also in the region of ski brakes. In order to provide for similar handling conditions in both positions of the hand device, it is provided in a first embodiment of the invention that the width of the second guide surface is greater than the width of the surface having the second dressing surface, wherein the relationships between the widths of the two surfaces of each pair of surfaces are substantially the same.

In a further embodiment, the two pairs of surfaces are arranged on congruent relationship on the holder, that is to say, the three-dimensional arrangement thereof is such that, upon a theoretical rotation of the pair of surfaces about a parallel axis, said pair can be transferred into the second pair of surfaces. Practical experience and testing has shown that such an arrangement of the surfaces affords a particular degree of user-friendliness when changing over dressing between the two surfaces of the edge of the ski, while in a preferred embodiment the two pairs of surfaces are arranged displaced at 180° relative to each other so that the two guide surfaces and the two dressing surfaces are respectively parallel to each other.

In a hand device of the kind set forth in the opening part of this specification, wherein the first guide surface is provided laterally on a bar member for holding down the tool, the pairs of surfaces according to the invention may be embodied in a particularly advantageous manner, with a congruent arrangement in which they are respectively displaced through 180°, if the holder is of L-shape in cross-section and the tool is fitted into the first limb portion of the holder, wherein it projects beyond the outside surface of the second limb portion, if the bar member is arranged in the region where the two limb portions are connected, if the tool has a second dressing surface which extends parallel to the first dressing surface and if the outside surface of the second limb portion as well as the second dressing surface which faces theretowards, of the tool which projects beyond the second limb portion, form the second pair of surfaces. That construction not only affords the advantage that the limb portion which carries the pair of surfaces which are not being used simultaneously forms the handle for gripping the device, but it also permits use of a commercially available portion, which is possibly cut to length, of a flat file, a milling plate or the like, as the tool, which has dressing surfaces provided with cutting edges at both sides. As the tool is arranged to be replaceable, it can be turned when the dressing surfaces are worn away, thus giving the maximum service time.

As already mentioned, it is advantageous for the dressing surfaces to adapt to the longitudinal curvature of the ski edges, which is concave in both directions. As the two dressing surfaces are formed by the two flat sides of the tool, it is necessary for it to flex towards both sides. A preferred further embodiment therefore provides that the flat tool is clamped between a projection on the bar member, which is disposed centrally thereof in the longitudinal direction, and a clamping screw which is displaceable in the second limb portion of the holder and which, by way of pressure member, acts against the tool at the side thereof which is remote from the projection, wherein the portions of the tool which extend in the longitudinal direction on both sides over the clamping region each have clearance on both sides relative to the bar member and to the holder.

The additional problem of the invention, which was put forward in preferred terms, can be solved by a further alternative form of the hand device, in that the guide surface at the second limb portion of the holder is divided into two longitudinal portions which are spaced relative to each other and of which the longitudinal portion which is more remote from the second dressing surface is formed by a longitudinal rib of the second limb portion, with respect to which the outside of the second limb portion is set back relative to the intersection with the second dressing surface. Accordingly, when setting a pair of surfaces which are not at a right angle and by means of which the running surface side of the above-mentioned 'hanging' edges can be dressed, independently thereof there also remains the second unaltered pair of surfaces with the surfaces disposed at a right angle to each other, which can be used for dressing the side surface side of the ski edges. By virtue of the adjustment of the contact member, the dressing surface remains in its original position, but when the hand device is applied to the running surface of the ski, it extends at the desired inclined angle of for example 1°–2°.

As almost all ski manufacturers produce at least skis in the upper price bracket with hanging ski edges, although the angle of inclination thereof is not the same, it is advantageous to be able to displace and fix the contact member. An easily adjustable embodiment therefore further provides that provided in the first limb portion of the holder is a recess or opening which extends in the longitudinal direction and which has a rising floor, wherein the contact member which has a floor which rises in the equal and opposite manner is longitudinally displaceably fitted into the recess and can be fixed in at least two positions. Therefore, for the purposes of determining the angle to be set, it is preferably provided that disposed on the contact member is a marking or a scale for indicating the angle between the contact surface of the contact member and the outside surface of the first limb portion, while associated with said marking or scale is a scale or marking respectively on the first limb portion. In that arrangement, the contact member is preferably fixed in any desired position by a clamping screw which is clamped from the inside of the first limb portion of the holder and which extends through a longitudinal slot that opens into the above-mentioned recess or opening.

Figure 2:
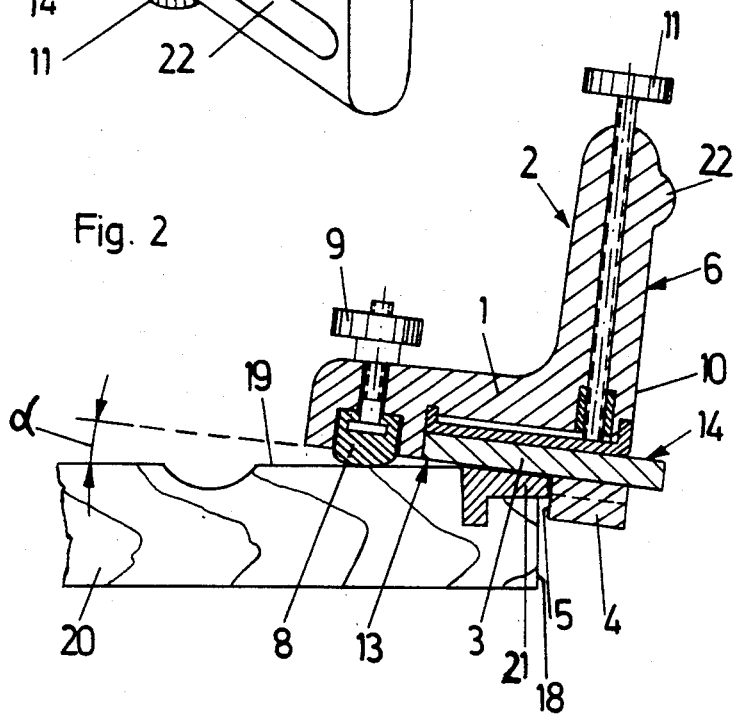
Figure 3:
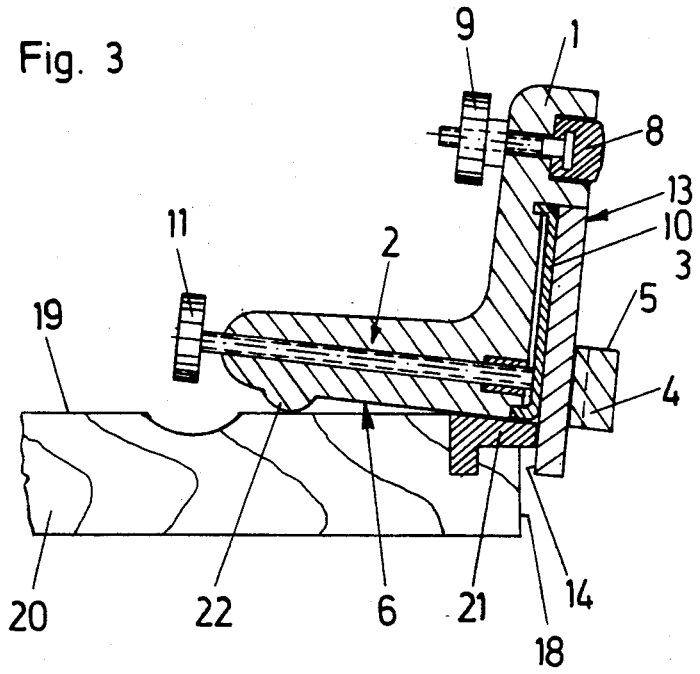
Figure 4:
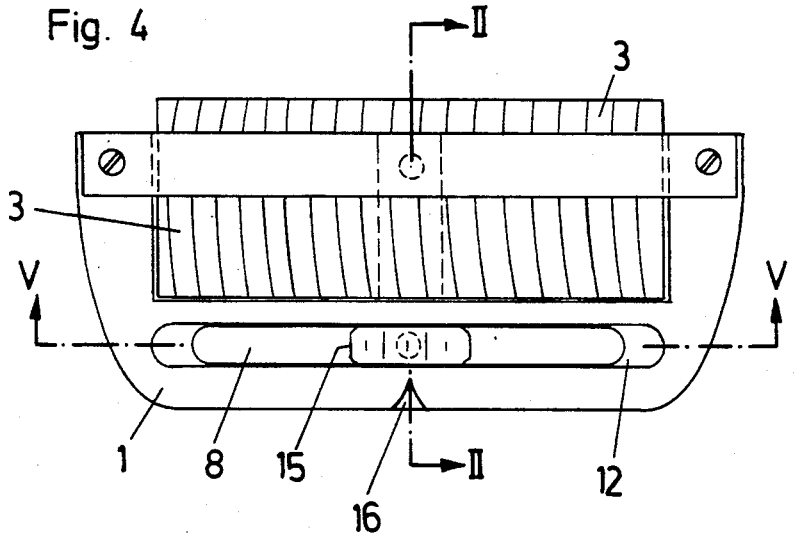
Figure 5:
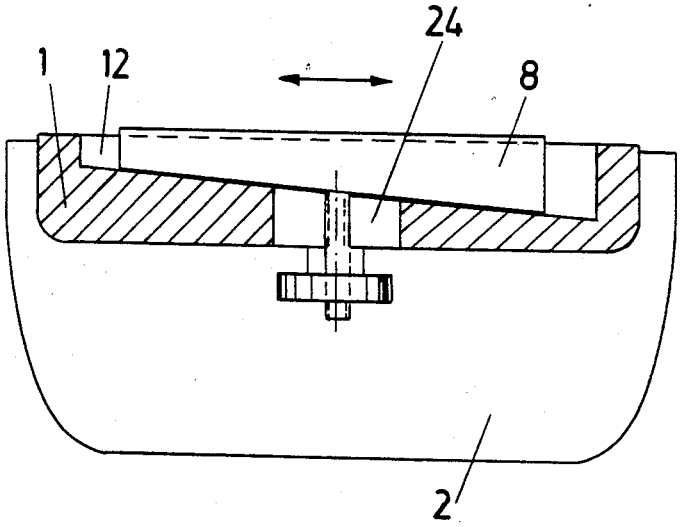
Figure 6:
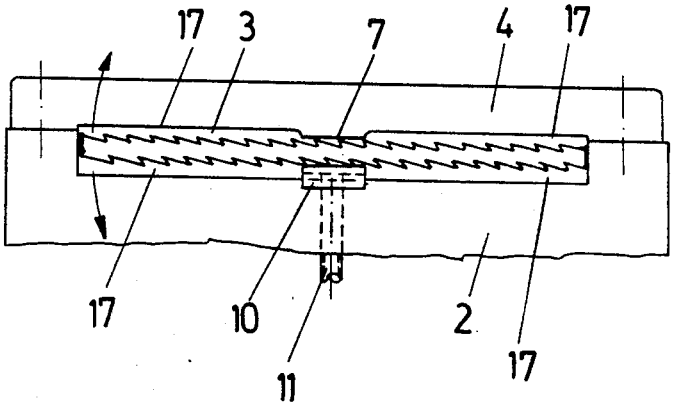

The invention will now be described in greater detail with reference to the accompanying drawings, without being restricted thereto. In the drawings:

FIG. 1 shows a perspective view of the hand device according to the invention,

FIGS. 2 and 3 show views in cross-section through the hand device when dressing the two surfaces of a hanging ski edge, with the angle of inclination being shown in exaggerated form, FIG. 4 shows a plan view on the first limb portion of the hand device, which is provided with the adjustable contact member, FIG. 5 is a view in section taken along line V—V in FIG. 4, and FIG. 6 is a plan view of the second limb portion of the hand device.

A hand device according to the invention is provided with a holder which is L-shaped in cross-section and whose two limb portions 1 and 2 are of substantially equal width. Fitted into a depression in the first limb portion 1 is a flat tool 3 which is provided with cutting edges on both sides, the top side thereof forming a first dressing surface 13. The tool 3 projects beyond the outward side of the second limb portion 2 to a small extent which preferably corresponds at most to the distance between the ski running surface 19 and the lower boundary of the brake members, when in a raised condition, of a ski brake. For the purposes of securing the tool 3 to the first limb portion 1, the arrangement has a clamp or bar member 4 which extends thereover only in the corner region of the holder, in the longitudinal direction, as well as a clamping screw 11 which acts on a pressure member 10. In that connection, the clamping screw 11 extends parallel to the outward side in the second limb portion 2 of the holder approximately at the center in the longitudinal direction thereof. The pressure member 10 which comprises a small narrow plate is fitted into a recess or opening, which is disposed at a central position in the longitudinal direction, in the depression in the first limb portion 1.

A projection 7 is provided on the bar member 4, towards the tool 3, in opposite relationship to the pressing member 10. The projection 7 is formed for example by a portion which is bent out from the bar member 4. Therefore, when the clamping screw 11 is tightened, the tool 3 is only clamped in the middle part between the projection 7 and the member 10 so that a gap 17 (see FIG. 6) remains between the two remaining parts of the tool 3 and the bar member 4 on the one hand and the first limb portion 1 on the other hand. The outward side of the first limb portion 1, which includes the dressing surface 13 of the tool 3, and the side surface of the bar member 4, which faces theretowards, form a first pair of surfaces with which the side surface of the ski edge 21, at the running surface, can be dressed, the arrangement providing wide contact at the running surface 19 and narrow contact at the guide surface 5 of the bar member 4. The thickness thereof is preferably also only the maximum distance between the running surface of the ski and the brake members, when in a raised condition, of a ski brake, so that the ski edge 21 can also be unimpededly dressed in the region of the binding. In that arrangement, as can be seen from FIG. 2, the second limb portion 2 of the holder serves as a handle. If the ski 20 is provided with a ski edge 21 which is referred to as a 'hanging' edge, as shown in FIGS. 2 and 3, wherein the side surface, at the running surface side, rises from the running surface 19 towards the side surface 18 of the ski, then, for the purposes of dressing same, it is necessary to provide an angle $\alpha$ of from 0.5° to 3°, preferably from 1° to 1.5°, between the outward side of the first limb portion 1 and the running surface 19 of the ski. Therefore, the outward side of the first limb portion 1 is wider than the width of the first dressing surface 13 formed by the tool 3, while a contact member 8 can be pushed out of the surface strip portion which remains therebeside, and comes to bear against the running surface 19 of the ski (FIG. 2). The surface on the first limb portion 1 of the holder, which includes the dressing surface 13, is therefore divided into two when the contact member 8 is pushed out. For the purposes of receiving the contact member 8, an opening or recess 12 of greater length is let into the first limb portion 1, the recess or opening 12 accommodating the member 8. The floor of the recess or opening 12 is arranged to rise in the longitudinal direction and the base surface of the member 8 which is displaceable in the recess or opening 12 is arranged to fall away at the same angle of inclination so that the contact surface of the member 8 with which it bears against the surface 19 of the ski is parallel to that surface in any position. A clamping screw 9 which passes through the limb portion 1 in a longitudinal slot therein fixes the contact member 8 in any position in the opening or recess 12. The line of intersection of the first guide surface on the member 4 with the first dressing surface 13 of the tool 3 and the contact surface of the member 8 are thus disposed in one plane, the angle of which relative to the outward side of the first portion 1 is adjustable by longitudinal displacement. For the purposes of determining the angle $\alpha$, a scale 15 is provided on the contact member 8 and a marking 16 is provided on the limb portion 1 (see FIG. 4) so that the marking 16 only has to be adjusted to be desired inclination of the hanging edge 21 of the ski, which can be read off on the scale 15.

In order now to give substantially identical operating and dressing conditions for the ski edge surface, at the side surface side thereof, a second congruent pair of surfaces 6 and 14 is provided on the holder. In that connection, as already mentioned, the second dressing surface 14 is formed by the flat side of the tool 3 which projects beyond the limb portion 2, that flat side being towards the second limb portion 2 of the holder. The second guide surface 6 of the second pair of surfaces is provided by the outward side of the second limb portion 2. FIG. 3 illustrates use thereof when dressing the lateral side edge surface, with the first limb portion 1 now serving as the handle. The outward side of the second limb portion 2 may be flat, thereby forming a wide second guide surface 6 which also again comes to bear against the running surface 19 of the ski, while, as already mentioned, the further dressing surface is substantially narrower. So that, when forming hanging ski edges 21, the two outside surfaces thereof are kept in a right-angled relationship, a longitudinal rib 22 may be provided on the outward side of the second limb portion 2 so that the second guide surface 6 is also divided into two mutually spaced surface strip portions which lie in a common plane that is perpendicular to the second dressing surface 14.

However, the longitudinal rib 22 is not absolutely necessary as the ski edge surface, at the side surface side, may also be ground parallel to the side surface 18 in regard to a hanging ski edge 21, so that it includes an obtuse angle which exceeds 90° by the angle $\alpha$, with the ski edge surface at the running surface side. Moreover, the longitudinal rib 22 could also be arranged to be adjustable in a similar manner to the contact member 8 in the first limb portion 1.

FIGS. 2 and 3 clearly show use of the hand device. Irrespective of which side surface of the ski edge 21 is being dressed, the arrangement provides in any case for wide contact in respect of the holder against the running surface 19, and very narrow contact against the side surface 18 of the ski.

As the ski edges 21 are swept or curved in the longitudinal direction, being therefore of a concavely curved configuration in two directions at least over their predominantly middle region of use, the tool can adapt to the curvature of the edge 21 by virtue of the tool 3 only being clamped at its centre, between the pressing member 10 and the projection 7. In that connection, the two free portions of the tool 3 may be deflected in any case in the gaps 17 at both sides thereof (see FIG. 6) so that both when the first dressing surface 13 (FIG. 2) is put under operating load and when the second dressing surface 14 is put under operating load, those surfaces are caused to bear completely against the ski edge side surface which is to be dressed.

The contact member 8 which is shown in greater detail in particular in FIGS. 4 and 5 could also be adjusted in other ways, as it would be possible for it to be acted upon by an adjusting screw, against the effect of a compression spring.

It is claimed:

1. A hand device for dressing ski edges, comprising a holder on which there is provided a pair of surfaces at right angles to each other, for bearing against the running surface and a side surface of the ski, of which one surface is formed at least in part as a cutting dress surface of a tool and the other is formed as a guide surface of the holder, wherein the width of the surface having the dressing surface is greater than the width of the guide surface, characterised in that provided on the holder is a further pair of surfaces at right angles to each other, comprising a second dressing surface and a second guide surface, wherein the width of the second guide surface is greater than the width of the guide surface of the first pair of surfaces.

2. A hand device according to claim 1 characterised in that the width of the second guide surface is greater than the width of the surface having the second dressing surface.

3. A hand device according to claim 1 characterised in that the two pairs of surfaces can be transferred one into the other upon notional rotation about an axis which is parallel to the two pairs.

4. A hand device according to claim 3 characterised in that the two pairs of surfaces are arranged displaced at 180° relative to each other.

5. A hand device according to claim 4 with a flat tool which is of limited flexibility and which is fitted into the holder and on which the first dressing surface is formed, a bar member of smaller width extending lengthwise over the first dressing surface, wherein the side surface of the bar member, which is towards the dressing surface, forms the first guide surface, characterised in that the holder is of L-shaped cross-section and the tool is fitted into the first limb portion of the holder, wherein it projects beyond the outside surface of the second limb portion, that the bar member is arranged in the connecting region of the two limb portions, that the tool has a second dressing surface which extends parallel to the first, and that the outside surface of the second limb portion as well as the second dressing surface, which is theretowards, of the tool which projects beyond the second limb portion, form the second pair of surfaces.

6. A hand device according to claim 5 characterised in that the flat tool is clamped between a projection on the bar member, which is disposed centrally in the lengthwise direction thereof, and a clamping screw which is displaceable in the second limb portion of the holder and which acts by way of a pressure member against the tool on the side which is in opposite relationship to the projection, wherein the portions of the tool which extend on both sides over the clamping region in the longitudinal direction have clearance on each side relative to the bar member and the holder.

7. A hand device according to claim 5 characterised in that the guide surface on the second limb portion of the holder is divided into two mutually spaced longitudinal portions of which the portion which is more remote from the second dressing surface is formed by a longitudinal rib of the second limb portion, with respect to which the outward side of the second limb portion is set back relative to the line of intersection with the second dressing surface.

8. A hand device in particular according to claim 1 characterised in that the wide surface, which contains the dressing surface, of the pair of surfaces, has, at the side in opposite relationship to the guide surface, with respect to the dressing surface, a surface portion out of which a contact member is arranged to be displaceable perpendicularly to the surface portion.

9. A hand device according to claim 5 characterised in that provided in the first limb portion of the holder is an opening or recess which extends in the longitudinal direction and which has a rising floor surface, wherein a contact member which has a floor surface which rises equally and in opposition thereto is longitudinally displaceably fitted into the recess and can be fixed in at least two positions.

10. A hand device according to claim 9 characterised in that disposed on the contact member is a marking or a scale indicating the angle ($\alpha$) between the contact surface of the contact member and the outside surface of the first limb portion, while associated with said marking or scale is a scale or marking respectively on the first limb portion.

11. A hand device according to claim 9 characterised in that the first limb portion has a longitudinal slot which extends parallel to the second limb portion and through which projects a clamping screw for fixing the contact member in any position in the opening or recess.

* * * * *